US009630815B2

(12) United States Patent
Gao et al.

(10) Patent No.: US 9,630,815 B2
(45) Date of Patent: Apr. 25, 2017

(54) MOVEMENT SYSTEM CONFIGURED FOR MOVING A PAYLOAD

(71) Applicants: GM GLOBAL TECHNOLOGY OPERATIONS LLC, Detroit, MI (US); Universite Laval, Quebec (CA)

(72) Inventors: Dalong Gao, Rochester, MI (US); Alexandre Lecours, Quebec (CA); Thierry Laliberte, Quebec (CA); Simon Foucault, Quebec (CA); Clement Gosselin, Quebec (CA); Boris Mayer-St-Onge, Quebec (CA); Roland J. Menassa, Macomb, MI (US); Pierre-Luc Belzile, Quebec (CA)

(73) Assignees: GM Global Technology Operations LLC, Detroit, MI (US); Universite Laval, Quebec (CA)

( * ) Notice: Subject to any disclaimer, the term of this patent is extended or adjusted under 35 U.S.C. 154(b) by 740 days.

(21) Appl. No.: 13/664,947

(22) Filed: Oct. 31, 2012

(65) Prior Publication Data

US 2013/0112644 A1 May 9, 2013

Related U.S. Application Data

(60) Provisional application No. 61/555,825, filed on Nov. 4, 2011.

(51) Int. Cl.

| | |
|---|---|
| ***B66C 17/00*** | (2006.01) |
| ***B66C 13/30*** | (2006.01) |
| ***B66C 23/00*** | (2006.01) |

(52) U.S. Cl.
CPC ..... *B66C 17/00* (2013.01); *B66C 13/30* (2013.01); *B66C 23/005* (2013.01)

(58) Field of Classification Search
CPC ..... B66C 17/00; B66C 17/06; B66C 23/005
USPC ..... 212/312, 313, 315, 317, 319
See application file for complete search history.

(56) References Cited

U.S. PATENT DOCUMENTS

| | | | | |
|---|---|---|---|---|
| 3,241,686 | A * | 3/1966 | Hurst | 212/319 |
| 3,262,593 | A * | 7/1966 | Hainer | 414/619 |
| 3,703,968 | A * | 11/1972 | Uhrich et al. | 414/680 |
| 4,790,441 | A * | 12/1988 | Hansen | 212/273 |

(Continued)

FOREIGN PATENT DOCUMENTS

| | | | |
|---|---|---|---|
| CN | 101450767 | A | 6/2009 |
| CN | 101759092 | A | 6/2010 |
| JP | 2000289976 | A | 10/2000 |

*Primary Examiner* — Emmanuel M Marcelo
*Assistant Examiner* — Justin Stefanon
(74) *Attorney, Agent, or Firm* — Quinn IP Law

(57) ABSTRACT

A movement device is moved along an X axis and a Y axis by providing a sensor configured to measure angle of rotation of at least one of a first and a second kinematic link about a respective axis of rotation. A force is imparted on the first and second kinematic links such that an angular displacement of the first and second kinematic links about the respective axis of rotation is achieved. The angular displacement of the first and second kinematic links about the respective axis of rotation is determined. The movement device is moved along the X axis and/or the Y axis in response to the determination of the angle of rotation of the first and second kinematic links about the respective axis of rotation until first and second kinematic links are vertical.

13 Claims, 5 Drawing Sheets

(56) References Cited

U.S. PATENT DOCUMENTS

| | | | | |
|---|---|---|---|---|
| 5,186,343 | A * | 2/1993 | Bozzi | 212/291 |
| 5,219,261 | A * | 6/1993 | Barry | 414/392 |
| 5,440,943 | A * | 8/1995 | Holt et al. | 74/89.23 |
| 5,498,121 | A * | 3/1996 | Todo et al. | 414/719 |
| 5,733,092 | A * | 3/1998 | Barry | 414/337 |
| 5,915,673 | A * | 6/1999 | Kazerooni | 254/270 |
| 6,557,235 | B1 * | 5/2003 | Katz et al. | 29/563 |
| 7,118,442 | B2 * | 10/2006 | Laliberte et al. | 446/85 |
| 8,317,453 | B2 * | 11/2012 | Givens | 414/680 |
| 8,973,768 | B1 * | 3/2015 | Jung et al. | 212/312 |
| 2008/0110844 | A1 | 5/2008 | Lewis et al. | |
| 2011/0127229 | A1 | 6/2011 | Laliberte et al. | |

* cited by examiner

MOVEMENT SYSTEM CONFIGURED FOR MOVING A PAYLOAD

CROSS-REFERENCE TO RELATED APPLICATIONS

This application claims the benefit of U.S. Provisional Patent Application No. 61/555,825 filed on Nov. 4, 2011, which is hereby incorporated by reference in its entirety.

TECHNICAL FIELD

The present disclosure relates to a movement system that is configured for moving a mass along an X axis and a Y axis in response to articulation of a movement device.

BACKGROUND

Overhead bridge cranes are widely used to lift and relocate large payloads. Generally, the displacement in a pick and place operation involves three translational degrees of freedom and a rotational degree of freedom along a vertical axis. This set of motions, referred to as a Selective Compliance Assembly Robot Arm ("SCARA") motions or "Schönflies" motions, is widely used in industry. A bridge crane allows motions along two horizontal axes. With appropriate joints, it is possible to add a vertical axis of translation and a vertical axis of rotation. A first motion along a horizontal axis is obtained by moving a bridge on fixed rails while the motion along the second horizontal axis is obtained by moving a trolley along the bridge, perpendicularly to the direction of the fixed rails. The translation along the vertical axis is obtained using a vertical sliding joint or by the use of a belt. The rotation along the vertical axis is obtained using a rotational pivot with a vertical axis.

There are partially motorized versions of overhead bridge cranes that are displaced manually along horizontal axes and rotated manually along the vertical axis by a human operator, but that include a motorized hoist in order to cope with gravity along the vertical direction. Also, some bridge cranes are displaced manually along all of the axes, but the weight of the payload is compensated for by a balancing device in order to ease the task of the operator. Such bridge cranes are sometimes referred to as assist devices. Balancing is often achieved by pressurized air systems. These systems need compressed air in order to maintain pressure or vacuum—depending on the principle used—which requires significant power. Also, because of the friction in the compressed air cylinders, the displacement is not very smooth and can even be bouncy. Balancing can be achieved using counterweights, which add significant inertia to the system. Although helpful and even necessary for the vertical motion, such systems attached to the trolley of a bridge crane add significant inertia regarding horizontal motion due to moving the mass of these systems. In the case of balancing systems based on counterweights, the mass added can be very large, even larger than the payload itself. If the horizontal traveling speed is significant, the inertia added to the system becomes a major drawback.

There are also fully motorized versions of such bridge cranes that require powerful actuators, especially for the vertical axis of motion which has to support the weight of the payload. These actuators are generally attached to the trolley or bridge and are then in motion. The vertical translation actuator is sometimes attached to the bridge and linked to the trolley by a system similar to what is used in tower cranes.

SUMMARY

A movement system is configured for moving a payload. The movement system includes a bridge crane, a trolley, and a movement device. The bridge crane is configured for movement along an X axis. The trolley is movably attached to the bridge crane and is configured for movement along a Y axis, in perpendicular relationship to the X axis. The movement device depends from the trolley along a Z axis. The movement device includes a first four-bar mechanism, a second four-bar mechanism, and a sensor. The second four-bar mechanism is operatively connected to, and suspended from, the first four-bar mechanism. Each four-bar mechanism has a pair of kinematic links and a pair of base links. The pair of kinematic links extend in spaced and parallel relationship to one another. The pair of base links extend in spaced and parallel relationship to one another and are pivotally connected to ends of the pair of kinematic links to form a first, second, third, and fourth joint therebetween. The pair of kinematic links and the corresponding pair of base links form a parallelogram. A first axis extends through the first joint of the first four-bar linkage and the third joint of the second four-bar linkage. A second axis extends through the second joint of the first four-bar linkage and the fourth joint of the second four-bar linkage. A third axis extends through the third joint of the first four-bar linkage and the first joint of the second four-bar linkage. A fourth axis extends through the fourth joint of the first four-bar linkage and the second joint of the second four-bar linkage. The first, second, third, and fourth axis extend in parallel relationship to one another. The kinematic links are rotatable about the respective axes. The axes of the first four-bar mechanism are disposed in perpendicular relationship to the axes of the second four-bar mechanism. The sensor is operatively attached to one of the joints of one of the first and second four-bar mechanisms. The sensor is configured to measure an angle of rotation of the respective kinematic link about the respective axis.

A movement device depends from a trolley along a Z axis and is configured for moving along at least one of an X axis and a Y axis. The movement device includes a first four-bar mechanism, a second four-bar mechanism, and a sensor. The second four-bar mechanism is operatively connected to, and suspended from, the first four-bar mechanism. Each four-bar mechanism has a pair of kinematic links and a pair of base links. The pair of kinematic links extend in spaced and parallel relationship to one another. The pair of base links extend in spaced and parallel relationship to one another and are pivotally connected to ends of the pair of kinematic links to form a first, second, third, and fourth joint therebetween. The pair of kinematic links and the corresponding pair of base links form a parallelogram. A first axis extends through the first joint of the first four-bar linkage and the third joint of the second four-bar linkage. A second axis extends through the second joint of the first four-bar linkage and the fourth joint of the second four-bar linkage. A third axis extends through the third joint of the first four-bar linkage and the first joint of the second four-bar linkage. A fourth axis extends through the fourth joint of the first four-bar linkage and the second joint of the second four-bar linkage. The first, second, third, and fourth axis extend in parallel relationship to one another. The kinematic links are rotatable about the respective axes. The axes of the first four-bar mechanism are disposed in perpendicular relationship to the axes of the second four-bar mechanism. The sensor is operatively attached to one of the joints of one of the first and second four-bar mechanisms. The sensor is configured to measure an angle of rotation of the respective kinematic link about the respective axis.

A method of moving a movement device along at least one of an X axis and a Y axis includes providing a sensor configured to measure angle of rotation of at least one of a first and a second kinematic link about a respective axis of rotation. A force is imparted on at least one of the first and second kinematic links such that an angular displacement of at least one of the first and second kinematic links about the respective axis of rotation is achieved. The angular displacement of the at least one of the first and second kinematic links about the respective axis of rotation is determined. The movement device is moved along the at least one of the X axis and the Y axis in response to the determination of the angle of rotation of the at least one of the first and second kinematic links about the respective axis of rotation until first and second kinematic links are vertical.

The above features and advantages, and other features and advantages of the present disclosure, will be readily apparent from the following detailed description of the embodiment(s) and best mode(s) for carrying out the described invention when taken in connection with the accompanying drawings and appended claims.

DETAILED DESCRIPTION

Figure 1:
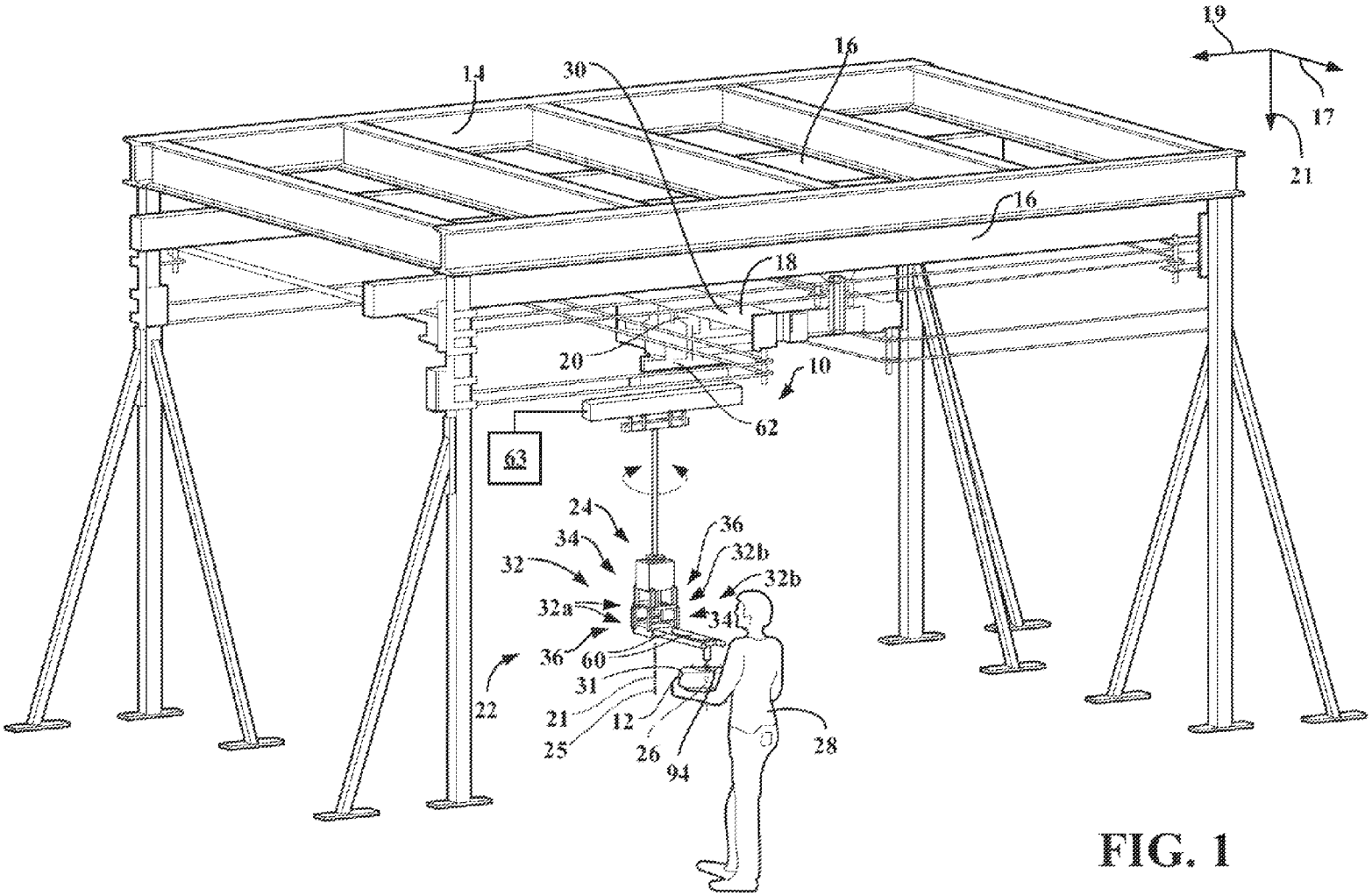
FIG. 1 is a schematic perspective view of a movement system including a movement device which is connected to a support structure.

Referring to the drawings, wherein like reference numbers refer to like components, a movement system 10 configured for moving a payload 12 in a plurality of directions is shown at 10 in FIG. 1. The movement system 10 is mounted to a stationary support structure 14 that is configured to support the movement system 10 and the payload 12. The support structure 14 includes, but is not limited to a pair of parallel rails 16 or runway tracks.

The movement system 10 includes a bridge crane 18, a trolley 20, and a movement device 22. The bridge crane 18 is a structure that includes at least one girder 30 that spans the pair of parallel rails 16. The bridge crane 18 is adapted to carry the payload 12 along a Y axis 19. The trolley 20 is movably attached to girders 30 of the bridge crane 18 such that the trolley 20 is adapted to carry the payload 12 along an X axis 17, in generally perpendicular relationship to the Y axis 19. The movement device 22 is operatively attached to the trolley 20. A Z axis 21 extends in a vertical direction, with respect to the ground, and is defined between the intersection of the X axis 17 and the Y axis 19.

Figure 3:
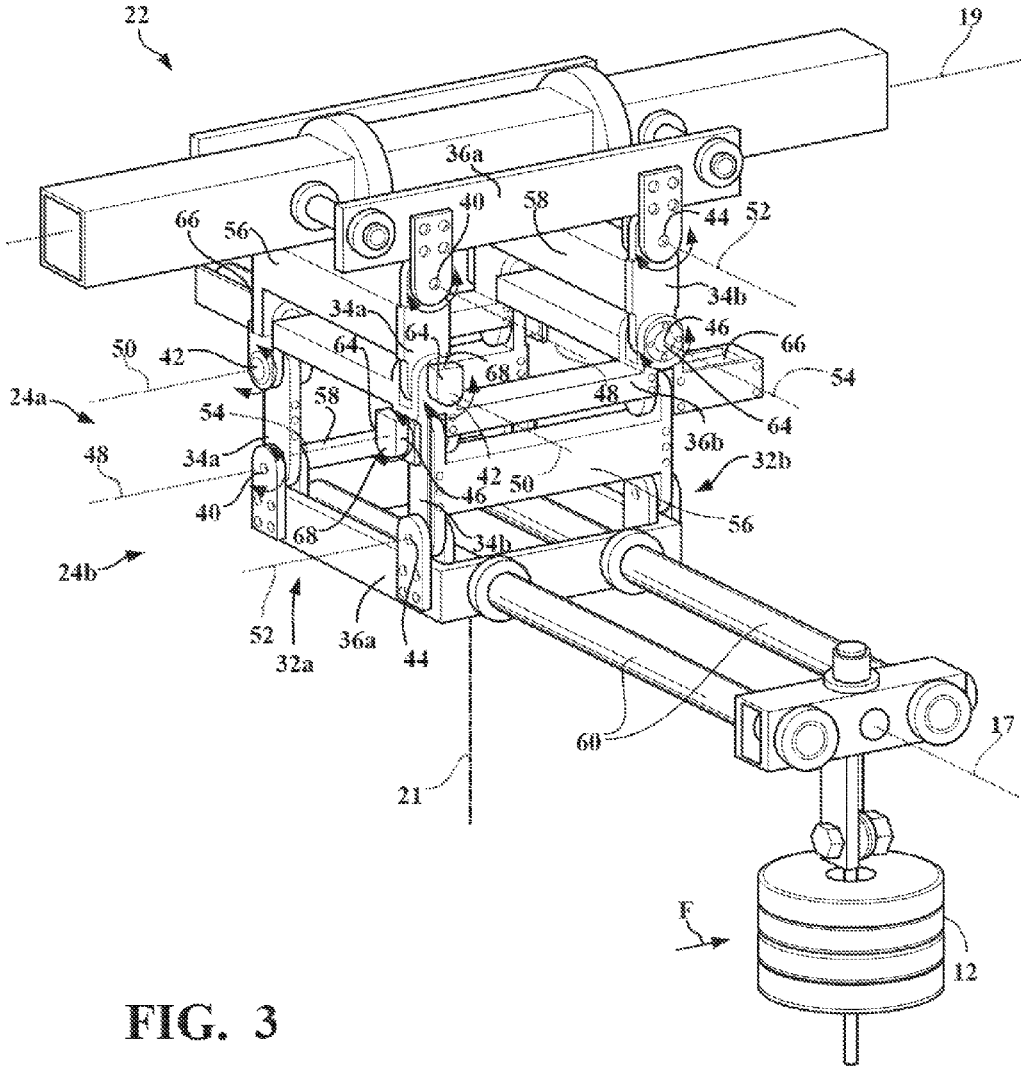
FIG. 3 is another schematic perspective view of the movement device of FIG. 1, configured for moving a payload along an X axis and a Y axis.

The movement device 22 includes four-bar mechanisms 24 and is configured to be a two degree-of-freedom articulated mechanism (X and Y). A two degree-of-freedom articulated mechanism is shown in FIGS. 1 and 3. The articulated mechanism includes four-bar mechanisms 24. Additionally, the movement device 22 may be configured to allow the center of mass 26 of the payload 12 to be offset from a center line 25 of the movement device 22.

Figure 2:
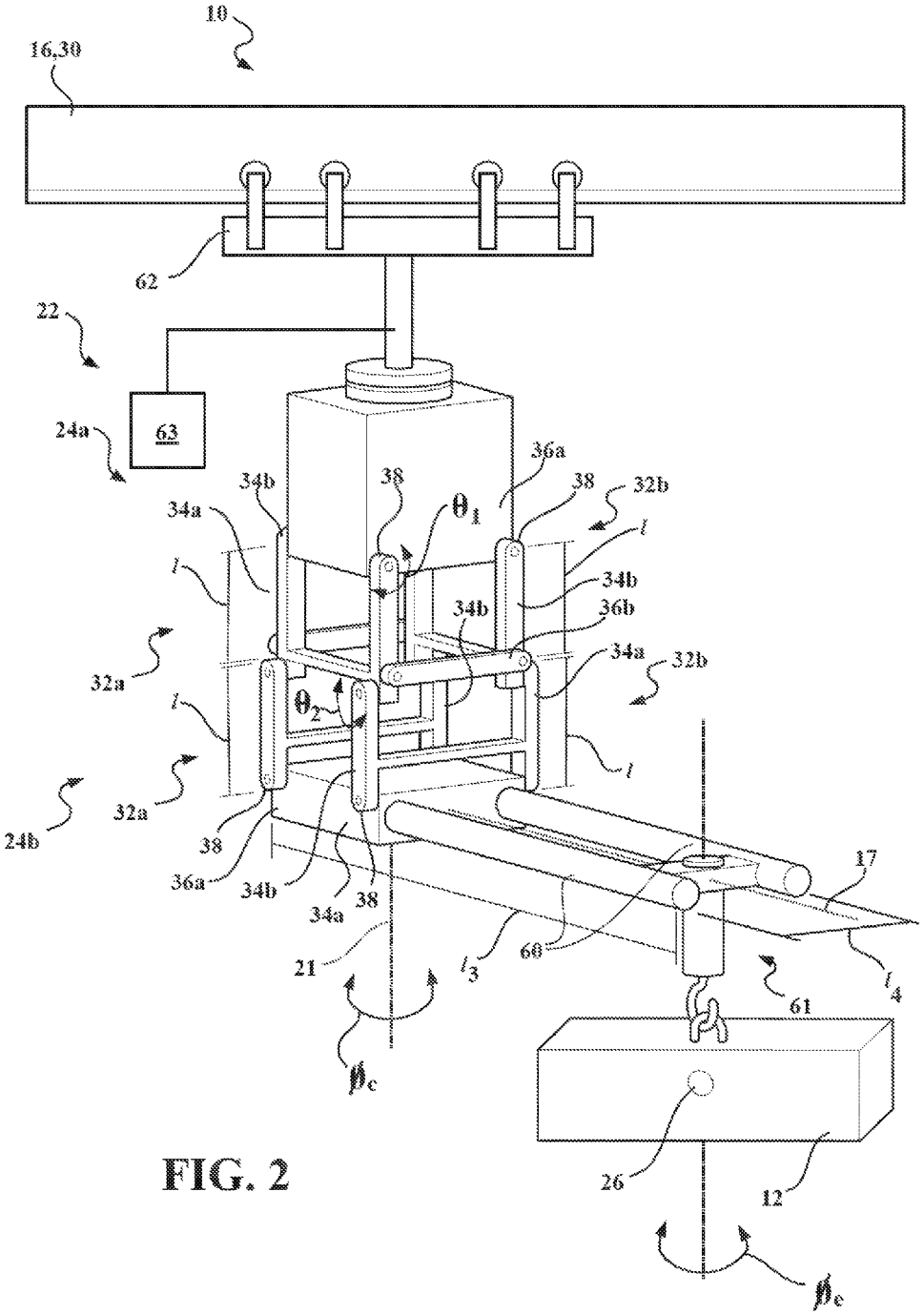
FIG. 2 is a schematic perspective view of the movement device of FIG. 1, configured for moving a payload along an X axis and a Y axis.

With reference to FIGS. 2 and 3, the movement device 22 includes a first four-bar mechanism 24*a* and a second four-bar mechanism 24*b* which is operatively connected to, and is suspended from, the first four-bar mechanism 24*a*. Each four-bar mechanism 24 includes a pair of four-bar linkages 32, i.e., a first four-bar linkage 32*a* and a second four-bar linkage 32*b*, which are rigid. Each four-bar linkage 32 includes a pair of kinematic links 34, i.e., a first kinematic link 34*a* and a second kinematic link 34*b*, and a pair of base links 36, i.e., a first base link 36*a* and a second base link 36*b*. The first base link 36*a* and the second base link 36*b* are disposed in spaced and parallel relationship to one another. Opposing ends 38 of the first kinematic link 34*a* are pivotally connected to ends 38 of the first and second base link 36*a*, 36*b* to form a respective first joint 40 and second joint 42 therebetween. The second kinematic link 34*b* is disposed in spaced and parallel relationship to the first kinematic link 34*a* and opposing ends 38 of the second kinematic link 34*b* are pivotally connected to ends 38 of the first and second base link 36*a*, 36*b* to form a respective third joint 44 and fourth joint 46 therebetween. Accordingly, each four-bar linkage 32 forms a parallelogram.

The first four-bar linkage 32*a* and the second four-bar linkage 32*b* of each of the first and second four-bar mechanisms 24*a*, 24*b* are disposed in spaced and generally parallel relationship to one another such that the first kinematic link 34*a* of the first four-bar linkage 32*a* is disposed in spaced and generally parallel relationship to the second kinematic link 34*b* of the second four-bar linkage 32*b* and the second kinematic link 34*b* of the first four-bar linkage 32*a* is disposed in spaced and generally parallel relationship to the first kinematic link 34*a* of the second four-bar linkage 32*b*. Additionally, the first base link 36*a* and the second base link 36*b* of the first four-bar linkage 32*a* are disposed in spaced and generally parallel relationship to a corresponding first base link 36*a* and second base link 36*b* of the second four-bar linkage 32*b*.

A first axis 48 extends through the first joint 40 of the first four-bar linkage 32*a* and the third joint 44 of the second four-bar linkage 32*b*. A second axis 50 extends through the second joint 42 of the first four-bar linkage 32*a* and the fourth joint 46 of the second four-bar linkage 32*b*. A third axis 52 extends through the third joint 44 of the first four-bar linkage 32*a* and the first joint 40 of the second four-bar linkage 32*b*. A fourth axis 54 extends through the fourth joint 46 of the first four-bar linkage 32*a* and the second joint 42 of the second four-bar linkage 32*b*. The first axis 48, second axis 50, third axis 52, and fourth axis 54 extend in spaced and generally parallel relationship to one another for each of the four-bar mechanisms 24*a*, 24*b*. Additionally, the first axis 48, second axis 50, third axis 52, and fourth axis 54 of the first four-bar mechanism 24*a* are generally perpendicular to the first axis 48, second axis 50, third axis 52, and fourth axis 54 of the second four-bar mechanism 24*b*.

Referring to FIGS. 1-3, each four-bar mechanism 24 includes a first connection link 56 and a second connection link 58. The first connection link 56 rigidly connects the first kinematic link 34*a* of the first four-bar linkage 32*a* and the second kinematic link 34*b* of the second four-bar linkage 32*b*. The second connection link 58 rigidly connects the second kinematic link 34*b* of the first four-bar linkage 32*a* and the first kinematic link 34*a* of the second four-bar linkage 32*b*. The rigid connections mean that the first kinematic link 34*a* of the first four-bar linkage 32*a* and the second kinematic link 34*b* of the second four-bar linkage 32*b* rotate in unison about the respective first and second axes. Likewise, the second kinematic link 34*b* of the first four-bar linkage 32*a* and the first kinematic link 34*a* of the second four-bar linkage 32*b* rotate in unison about the respective third and fourth axes. The first and second four-bar linkages 32*a*, 32*b* and the first and second connection links 56, 58 are used for each four-bar mechanism 24 such that each four-bar mechanism 24 can sufficiently support required forces, moments, and torques. Roller bearings may also be disposed in the joints 40, 42, 44, 46 in order to reduce friction.

The first four-bar mechanism 24*a* is operatively attached to the trolley 20. More specifically, the first four-bar mechanism 24*a* depends from the trolley 20. The second four-bar mechanism 24*b* depends from the first four-bar mechanism 24*a*. More specifically, the second four-bar mechanism 24*b* depends from the first four-bar mechanism 24*a* such that the first axis 48, second axis 50, third axis 52, and fourth axis 54 of the first four-bar mechanism 24*a* are in generally perpendicular relationship to the first axis 48, second axis 50, third axis 52, and fourth axis 54 of the second four-bar mechanism 24*b*.

Referring to FIGS. 2 and 3, a pair of tubes 60 extend from the second four-bar mechanism 24*b*, along the X axis 17. The payload 12 is suspended from at least one of these tubes 60 and is offset from the Z axis 21.

Figure 4:
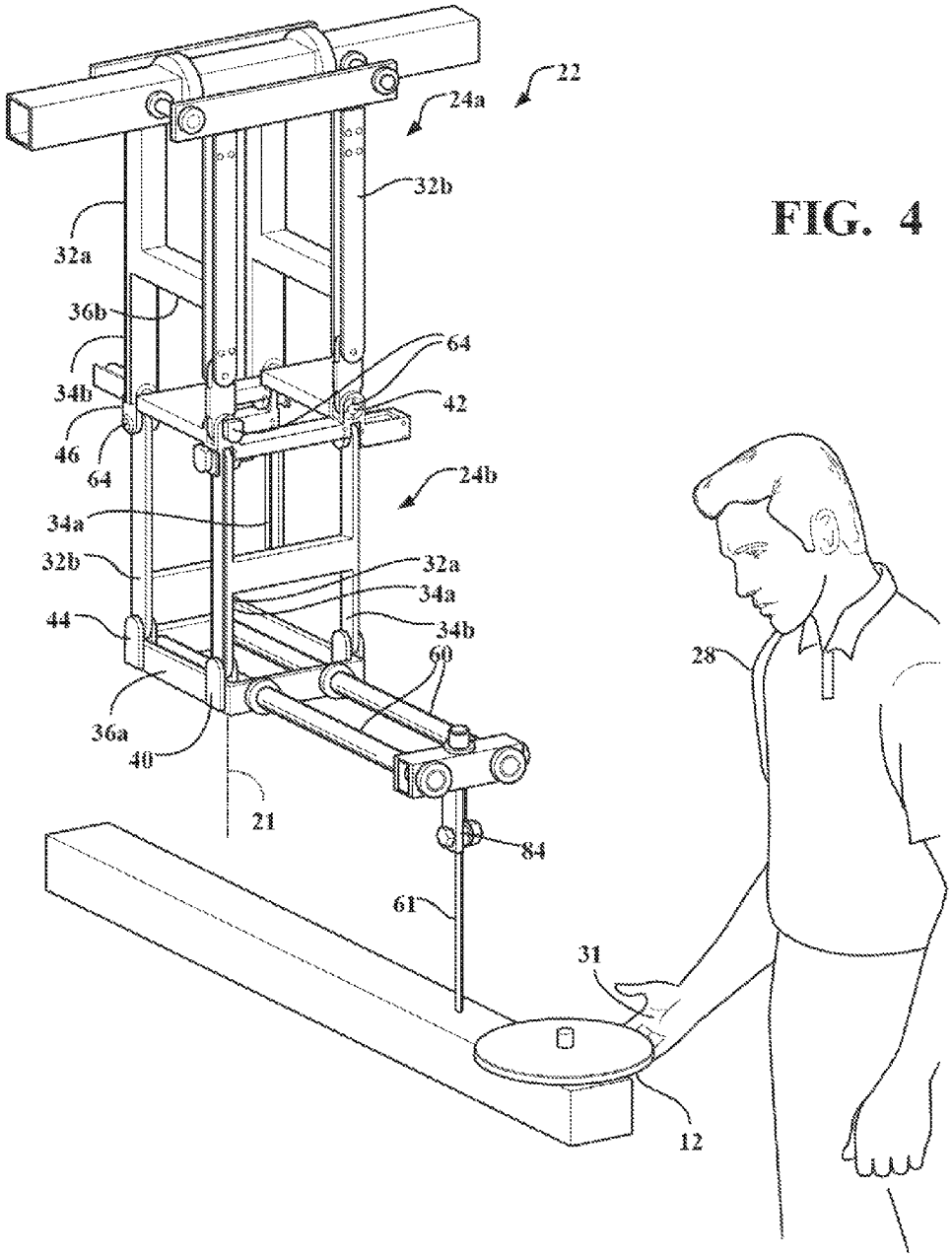
FIG. 4 is a schematic perspective view of the movement device of FIG. 3 having an articulated mechanism and the payload supported by the articulated mechanism.

Referring to FIG. 4, an articulated joint 61 may extend from one or both of the tubes 60 and further extend in an X and/or Y direction which is further offset from the Z axis 21. The payload 12 may extend from the articulated joint 61 at an attachment point 84. The payload 12 may be offset from the attachment point 84.

During operation, an oscillation frequency of the movement device 22 is a function of a length L of the kinematic links 34, but not on a position of the center of mass 26 of the payload 12, with respect to the Z axis 21. Shorted kinematic link 34 lengths L may be used to save space, while longer kinematic link 34 lengths L may be used to reduce the oscillation natural frequency.

The movement device 22 includes a cart 62 and a controller 63. The cart 62 is configured for moving the bridge crane 18 and/or the trolley 20 along the respective X axis 17 and Y axis 19 in response to the application of a force F to the payload 12. As the force F is applied to the payload 12 a direction along the X axis 17 and/or the Y axis 19, the kinematic links 34 of the first and/or second four-bar mechanism 24*a*, 24*b* rotate about the respective axes. Sensors 64 are operatively connected to at least one joint of each of the first and second four-bar mechanisms 24*a*, 24*b*. These sensors 64 measure an angle of rotation $\theta_1$ and $\theta_2$ of the kinematic links 34 about the respective axes. The sensor 64 may include an encoder 66 and a Hall effect sensor 68 operatively disposed along the respective axis. While only one sensor 64 may be used per axis, signals from the combination of the encoder 66 and the Hall effect sensor 68 can be combined by using data fusion to obtain improved signal quality over using a single sensor 64. Additionally, using two signals provides redundancy such that signals from both sensors 64 can be compared to one another to detect any signal problems. Additionally, the Hall effect sensor 68 provides an absolute signal, whereas the encoder 66 offers a precise signal. It should be appreciated that other sensors 64 may also be used. Absolute encoders, potentiometers or linear accelerometers (used as inclinometers) could be used as the position sensor. A gyroscope could be used to obtain the angular velocity while an accelerometer could be used to obtain angular acceleration. Accelerometers or gyroscopes placed on slotted parts could also help determine different dynamical effects. Photointeruptors could also be used at strategic places. Finally, the above signals can be derived/integrated to obtain corresponding signals.

The angular displacement and angular velocity estimations are obtained from the Kalman state estimation. Each signal, i.e., from the encoder 66 and the Hall effect sensors 68, are independently Kalman filtered and then combined in proportion of their Kalman covariance matrix corresponding state value.

Figure 5:
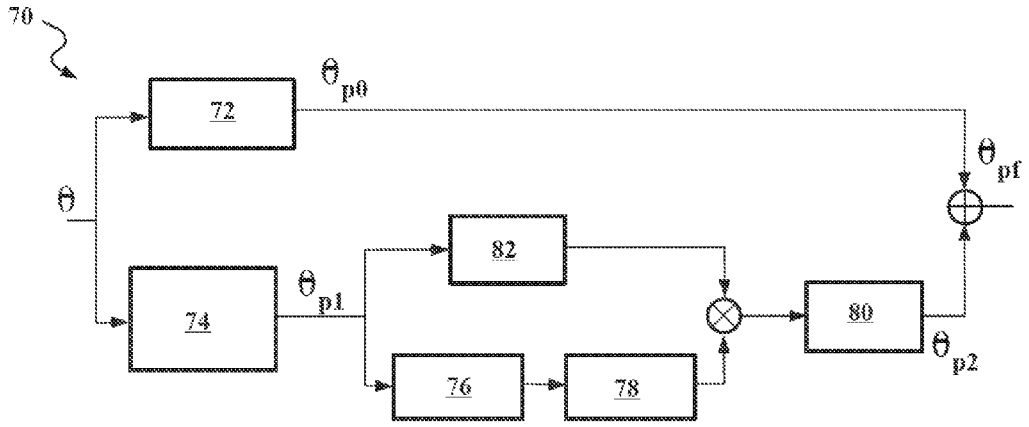
FIG. 5 is a schematic block diagram of a high frequency oscillation scheme usable with the controller shown in FIG. 1.

In order to be desensitized to small angle measurement precision errors, a deadband on the angle may be used. The deadband is an area of a sign range where no action on the system occurs. The movement device 22 may also be excited by small amplitude, high frequency unmodeled dynamics or it may be difficult for the control to manage high frequency oscillations. During oscillations, when the kinematic links 34 are close to a vertical position, since the angle measurement often changes sign, it becomes difficult to suppress the oscillations. One method of suppressing these oscillations is to increase the angle deadband. An algorithm, shown as an oscillation logic block 70 in FIG. 5, is provided to compensate for high frequency oscillations, while keeping precision and performance to keep the kinematic links 34 vertical. For a small deadband, $\theta_{db1}$ is still used to cope with precision errors of the angle measurements. Two other angles are defined, $\theta_{db2}$ and $\theta_{db3}$. The signal $\theta_{p0}$ is determined in a deadband block 72 and expressed as follows:

$$\theta_{db1} = \begin{cases} 0 & \text{if } -\theta_{db1} < \theta < \theta_{db1} \\ \theta - \theta_{db1} & \text{if } \theta > \theta_{db1} \\ \theta = \theta_{db1} & \text{if } \theta < -\theta_{db1} \end{cases}$$

$$\theta_{p0} = \begin{cases} 0 & \text{if } -\theta_{db1} < \theta < \theta_{db1} \\ \theta - \theta_{db1} & \text{if } \theta > \theta_{db1} \\ \theta + \theta_{db1} & \text{if } \theta < -\theta_{db1} \end{cases}$$

and the signal $\theta_{p1}$ is determined in a deadband and saturation block 74 and expressed as follows:

$$\theta_{p1} = \begin{cases} 0 & \text{if } -\theta_{db2} < \theta < \theta_{db2} \\ \theta - \theta_{db2} & \text{if } \theta_{db2} < \theta < \theta_{db3} \\ \theta + \theta_{db2} & \text{if } -\theta_{db2} > \theta > -\theta_{db3} \\ \theta_{db3} - \theta_{db2} & \text{if } \theta > \theta_{db3} \\ -\theta_{db3} + \theta_{db2} & \text{if } \theta < -\theta_{db3} \end{cases}$$

The signal $\theta_{p0}$ then corresponds to the input angle signal above $\theta_{db1}$ while $\theta_{p1}$ corresponds to the input signal between $\theta_{db2}$ and $\theta_{db3}$. In order to remove the high frequency oscillations from $\theta_{p1}$, this signal is further processed. While a low pass filter could be used, phase delays may result, causing system instability. The absolute signal of $\theta_{p1}$ is determined in an absolute logic block 76 and then the absolute signal passes through a rate limiter block 78. The rising limit is low and the falling limit is high, such that it takes time for the output signal to increase, filtering high frequency oscillations. However, the signal of the $\theta_{p1}$ can return to zero rapidly, avoiding a phase shift. This signal is then multiplied by the sign of $\theta_{p1}$, stored in a sign block 82. The resulting signal, can then optionally be slightly filtered with a usual low pass filter at a low pass block 80, resulting in the signal $\theta_{p2}$. Although, $\theta_{p0}$ and $\theta_{p2}$ can be used individually in the control, they can also be grouped as:

$$\theta_{pf}=\theta_{p0}+\theta_{p2}$$

In the following, the equations of motion are first obtained with a complete model called coupled motion. Then, with simplifications, a simplified model is obtained. With reference to FIG. 2, the following velocities are obtained:

$$\dot{X}_p=\dot{X}_c+L\cos\theta_1\dot{\theta}_1-l_4\dot{\phi}$$

$$\dot{Y}_p=\dot{Y}_c+L\cos\theta_2\dot{\theta}_2-l_3\dot{\phi}$$

$$\dot{Z}_p=\dot{Z}_c+L\sin\theta_1\dot{\theta}_1+L\sin\theta_2\dot{\theta}_2$$

$$\dot{\phi}_p=\dot{\phi}_c+\dot{\phi}_e$$

where $X_p$, $Y_p$ and $Z_p$ are the payload 12 center of mass position in fixed coordinates (the X axis 17 is aligned with the tubes 60), $X_C$, $Y_C$, $Z_C$ are the cart 62 coordinates in fixed coordinates, $\phi_C$ is the mechanism rotation about the vertical axis and $\phi_e$ is the payload 12 rotation about the end-effector axis. $\phi_p$ is the total translation of $\phi_e$ plus $\phi_c$. The potential energy is provided as follows:

$$V=mgL(\cos\theta_1+\cos\theta_2)-Z_c$$

where m is the payload 12 mass and the kinetic energy is expressed as:

$$T=\frac{1}{2}M_x\dot{X}_c^2+\frac{1}{2}M_y\dot{Y}_c^2+\frac{1}{2}M_z\dot{Z}_c^2+\frac{1}{2}m\left(\dot{X}_p^2+\dot{Y}_p^2+\dot{Z}_p^2\right)$$

where $M_X$ is the cart 62 mass in the X direction and $M_Y$ the cart 62 mass in the Y direction and $M_Z$ is the cart 62 mass in the Z direction. One should note that masses of the kinematic links 34 were neglected. The equations of motion are obtained from the previous two equations and the Lagrange method as follows:

$$F_X=M_x\ddot{X}_c+m(\ddot{X}_c-L\sin\theta_1\dot{\theta}_1^2+L\cos\theta_1\ddot{\theta}_1-l_4\ddot{\phi})$$

$$F_Y=M_y\ddot{Y}_c+m(\ddot{Y}_c-L\sin\theta_2\dot{\theta}_2^2+L\cos\theta_2\ddot{\theta}_2-l_3\ddot{\phi})$$

$$F_Z=M_z\ddot{Z}_c+m(\ddot{Z}_c+L\cos\theta_1\dot{\theta}_1^2+L\sin\theta_1\ddot{\theta}_1+L\cos\theta_2\dot{\theta}_2^2+L\sin\theta_2\ddot{\theta}_2+g)$$

$$F_{\theta 1}=0=mL(\ddot{X}_c+L\cos\theta_1-l_4\cos\theta_1\ddot{\phi}+\ddot{Z}_c\sin\theta+L\ddot{\theta}_1+L\sin\theta_1\cos\theta_2\dot{\theta}_2^2+L\sin\theta_1\sin\theta_2\ddot{\theta}_2+mg\sin\theta_1)$$

$$F_{\beta 1}=0=mL(\ddot{Y}_c\cos\theta_2+l_3\cos\theta_2\ddot{\phi}+\ddot{Z}_c\sin\theta_2+L\ddot{\theta}_2+L\sin\theta_2\cos\theta_1\dot{\theta}_1^2+L\sin\theta_1\sin\theta_2\ddot{\theta}_1+mg\sin\theta_2)$$

One should note that similar equations could be found with the other angle representation as ($\theta_2$, $\beta_2$). Additionally, the coupling between angles $\theta_1$ and $\theta_2$ is negligible for relatively small angles and angular velocities. Thus, motion along the X axis 17 and Y axis 19 will be treated separately, as described below.

Referring to FIG. 4, with only one degree-of-freedom where $\theta$ refers to $\theta_1$ or $\theta_2$, while the other angle remains fixed, and a small rotation rate, equations of motion are as follows:

$$F=(M+m)\ddot{x}+m\ddot{\theta}L\cos\theta=mL\dot{\theta}^2\sin\theta+2m\dot{\theta}\dot{L}\cos\theta$$

$$\tau=0=(\ddot{x}\cos\theta+g\sin\theta+L\ddot{\theta}+2\dot{L}\dot{\theta})mL$$

which can be simplified to the pendulum equations for constant link lengths L of the kinematic links 34 as follows:

$$F=(M+m)\ddot{x}+m\ddot{\theta}L\cos\theta-mL\dot{\theta}^2\sin\theta$$

$$\tau=0=(\ddot{x}\cos\theta+g\sin\theta+L\ddot{\theta})mL$$

where M is the mass of the cart 62 and m is the mass of the payload 12. Assuming small angles and a slowly varying vertical translation and neglecting $\dot{\theta}^2$, the equations can be approximated as follows:

$$F=(M+m)\ddot{x}+m\ddot{\theta}L$$

$$0=\ddot{x}+g\theta+L\ddot{\theta}$$

The movement mechanism may be operated in a cooperation mode. It is possible to manage an offset of the center of mass 26 of the payload 12 from the central line 25. In FIGS. 2 and 3, the offset is from the movement device 22 and in FIG. 4, the offset is from the attachment point 84, allowing the operator 28 to operate the movement device 22 by placing their hands 31 directly on the payload 12. The movement mechanism allows the operator 28 to impart an angle $\theta_1$ and $\theta_2$ to the movement device 22, i.e., the first four-bar mechanism 24*a* and the second four-bar mechanism 24*b*, by pushing the payload 12, and this angle $\theta_1$ and $\theta_2$ is measured by the sensors 64. The operator 28 is permitted to place their hands 31 directly on the payload 12 because the angles $\theta_1$ and $\theta_2$ imparted to the links of the first four-bar mechanism 24*a* and the second four-bar mechanism 24*b*, which are measured by the sensors 64, are done above the payload 12. The control system moves the cart 62 in response to the angle $\theta_1$ and $\theta_2$ measured by the sensors 64 to keep the kinematic links 34 vertical. Thus, the cart 62 moves in the direction desired by the operator 28, while controlling any sway of the kinematic links 34, resulting in assistance to the operator 28. Additionally, since the controller 63 insures that the kinematic links 34 remain vertical, the operator 28 is not required to manually stop the load, since the control system manages itself to stop the payload 12. An autonomous mode, where the payload 12 position is prescribed, while reducing links sway, may also be desired.

More specifically, the angle $\theta_1$ and $\theta_2$ is imparted by the kinematic links 34 of the first and/or second four-bar mechanisms 24*a*, 24*b* pivoting about the axes in response to the operator 28 pushing on the mechanism. An objective of the control system is to move the overhead cart 62, in response to the imparted angles $\theta_1$ and $\theta_2$ to keep the kinematic links 34 vertical. Thus, the cart 62 moves in the direction imparted by the operator 28 to the payload 12, while controlling swaying of the kinematic links 34. Additionally, since the controller 63 ensures that the kinematic links 34 remain vertical, the operator 28 is not required to stop the load. More specifically, the control system functions to stop the cart 62, and the associated payload 12.

The force F required for an operator 28 to move the payload 12 would be reduced because a measure of the imparted angle(s) $\theta_1$ and $\theta_2$ of the kinematic links 34 about the respective axes can be precisely and accurately measured. This results in a system that moves along the corresponding X axis 17 and/or Y axis 19.

Figure 6:
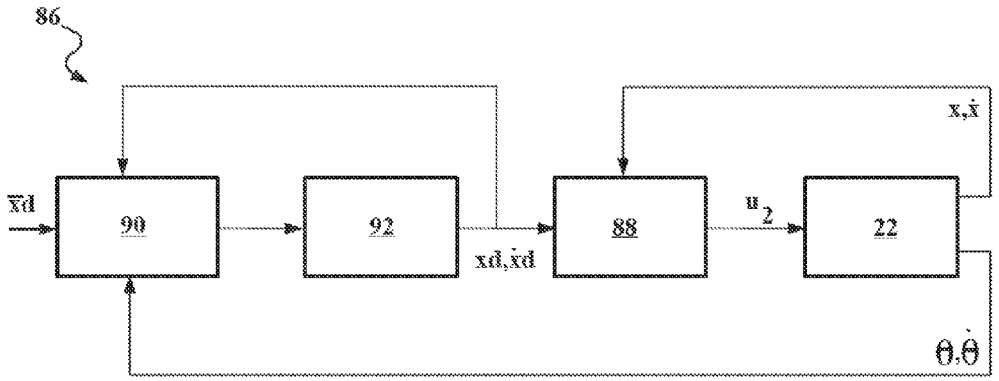
FIG. 6 is a schematic block diagram of a control scheme usable with the controller shown in FIG. 1.

The controller 63 includes a control block 86, shown in FIG. 6, which is configured to operate for cooperative motion or autonomous motion. The cart 62 acceleration will be considered as the input. The payload 12 and cart 62 mass do not need to be known. The following equations are obtained in a Laplace domain as follows:

$$\ddot{X}(s)+g\theta(s)+s^2L\theta(s)=0$$

The state-space representation is as follows:

$$\dot{\bar{x}}_S=A_S\bar{x}_S+B_Su_S$$

$$y_S=C_S\bar{x}_S+D_Su_S$$

where $y_S$ the output vector, $\bar{x}_S$ is the state vector, us is the input scalar, $A_S$ is an n×n state matrix, $B_S$ is an n×m input matrix, $C_S$ is a p×n output matrix, $D_S$ is a p×m feed through matrix and where n is the number of states, m is the number of inputs and p is the number of outputs. Here, $\bar{x}_S=[x\ \dot{x}\ \theta\ \dot{\theta}]^T$ and $u_S=\ddot{x}$, with $$A_S=\begin{bmatrix}0 & 1 & 0 & 0\\ 0 & 0 & 0 & 0\\ 0 & 0 & 0 & 1\\ 0 & 0 & \frac{-g}{L} & 0\end{bmatrix}$$

and $$B_S=\begin{bmatrix}0\\ 1\\ 0\\ \frac{-1}{L}\end{bmatrix}$$

The above equation, obtained from the Laplace domain, is used, where $u=\ddot{x}$, the control law is $u_S=K_Re$, where:

$$K_Re=[\,K_x\quad K_v\quad -K_\theta\quad -K_{\theta p}\,]$$

and $$e=\begin{bmatrix}x_d & -x\\ \dot{x}_d & -\dot{x}\\ \theta_d & -\theta\\ \dot{\theta}_d & -\dot{\theta}\end{bmatrix}$$

where $\dot{x}_d$, $\theta_d$, and $\dot{\theta}_d$ equal zero.

Referring again to the control logic block of FIG. 6, the input, $u_S$, is the acceleration of the cart 62, and because controlling acceleration is not practical, velocity control is used in the cooperation mode and position control is used in the autonomous mode. The output of the latter lower level controller block 88 is shown as $u_2$ in FIG. 6.

In the cooperation mode, the state space controller block 90 output of FIG. 6 is obtained as a discrete velocity with a zero-order-hold integration, as follows:

$$\ddot{x}_{d(k)}=u=K_re$$

$$\dot{x}_{d(k)}=\dot{x}_{d(k-1)}+\ddot{x}_{d(k)}T_s$$

Likewise, in the autonomous mode, the state space controller block 90 output of FIG. 6 is obtained as a position by integrating once more, as follows:

$$x_{d(k)}=x_{d(k-1)}+\dot{x}_{d(k-1)}T_S+0.5\ddot{x}_{d(k)}T_S^2$$

It should be appreciated that the measured velocity could be used in the preceding equations, instead of the last time step desired value.

One should note that the measured velocity could be used in the preceding equations instead of the last time step desired value. This integration method is used to achieve acceleration control in an admittance control scheme. The desired acceleration is then obtained by using velocity or position control, which is more practical. It is also possible to additionally use computed torque control using the previous force equations. Although the payload 12 and cart 62 mass would then be required, an approximation is sufficient since feedback control is also used. Additionally, the payload 12 and cart 62 mass are not required in order to adapt the state space controller block 90 gains to varying parameters. Additionally, a limit and saturation block 92 may be used for virtual walls and to limit velocity and acceleration of the cart 62.

In the cooperation mode, since there is no reference position, $K_x$ is set to zero. The control gain $K_{\theta p}$, i.e., gain on the angular velocity signal, can be optionally used, depending on the angle derivative signal quality. An adaptive controller 63, based on pole placement and state space control may be used. The pole of the system may be obtained by:

$$det[sI-A+BK_r]$$

leading to the equation:

$$\frac{s^3L+s^2(K_\theta p+K_vL)+s(g+K_\theta)+K_vg}{L}$$

where $K_\theta$ and $K_{\theta p}$ are assumed negative.

The transfer function from angle θ to an angle initial condition $\theta_0$ is as follows:

$$\frac{\theta_0(s+K_v)L_s}{s^3L+s^2(K_\theta p+K_vL)+s(g+K_\theta)+K_vg}$$

The poles may be placed to the following:

$$(s+p_1)(s^2+2\zeta_1\omega_{n1}+\omega_{n1}^2)$$

In a first method, Kv and $K_\theta$ are used, which leads to the following:

$$K_v=p_1+2\zeta_1\omega_{n1}p_1$$

$$\frac{g}{L}+\frac{K_\theta}{L}=\omega_{n1}^2+2\zeta_1\omega_{n1}$$

$$\frac{K_vg}{L}=p_1\omega_{n1}^2$$

and then, the following are used:

$$p_1=\frac{2g\zeta_1\omega_{n1}}{-g+\omega_{n1}^2L}$$

$$K_v=\frac{p_1\omega_{n1}^2L}{g}$$

$$K_\theta=\left(\omega_{n1}^2-\frac{g}{L}+2\zeta\omega_{n1}p_1\right)L$$

where

-continued $$\omega_{n1} \geq \sqrt{\frac{g}{L}}$$

and $\zeta$ are design parameters. The control gains are thus obtained. The transfer function zero influences the response, but without practical effect, since it is relatively high, $\omega_{n1}$ is chosen very close to $$\sqrt{\frac{g}{L}},$$

but not too close to avoid numerical problems.

Referring again to FIG. 3, the control scheme is then used with these gains to manage the cooperation with the operator 28, while stabilizing the movement device 22.

In a second method, Kv, $K_\theta$, and $K_{\theta p}$ are used, which leads to the following:

$$K_v + \frac{K_{\theta p}}{L} = p_1 + 2\zeta_1\omega_{n1}$$

$$\frac{g}{L} + \frac{K_\theta}{L} = \omega_{n1}^2 + 2\zeta_1\omega_{n1}p_1$$

$$\frac{K_v g}{L} = p_1\omega_{n1}^2$$

The second method allows the poles to remain constant. Using the gain $K_{\theta p}$ allows the cart 62 to move in regards to the angle and angular velocity. The following is then obtained:

$$p_1 = \frac{-g(K_{\theta p} - 2\zeta\omega_{n1}^2 L)}{L(-g + \omega_{n1}^2 L)}$$

$$K_v = \frac{p_1\omega_{n1}^2 L}{g}$$

$$K_\theta = \left(\omega_{n1}^2 - \frac{g}{L} + 2\zeta\omega_{n1}p_1\right)L$$

where $$\omega_{n1} \geq \sqrt{\frac{g}{L}},$$

$\zeta$, and $K_{\theta p}$ are design parameters. The control gains are thus obtained. The transfer function zero influences the response, but without practical effect since it is relatively high, $\omega_{n1}$ is chosen very close to $$\sqrt{\frac{g}{L}},$$

but not too close to avoid numerical problems.

Referring again to FIG. 3, the control scheme is then used with these gains to manage the cooperation with the operator 28, while stabilizing the movement device 22.

Neglected terms from the complete model as $\dot{L}$, $\dot{\beta}$, $\dot{\theta}^2$ and viscous friction can be compensated for, for example, with gains $K_\theta$ and $K_{\theta p}$ by considering the terms constant over a time step, similarly as with the lengths L of the kinematic links 34.

Control gains may also be heuristically modified from the computed gains. Additionally, control gains on $\theta_{p0}$ and $\theta_{p2}$ and their derivatives may be different from each other.

In the autonomous mode, $K_x$ is used to control the cart 62 position. The control gain $K_{\theta p}$ can be optionally used. An adaptive controller 63 based on pole placement and state space control using $K_{\theta p}$ is provided. Similar to the cooperation mode, the system poles are:

$$\frac{s^4L + s^3(K_\theta p + K_v L) + s^2(g + K_\theta + K_x L) + s(K_v g) + K_x g}{L}$$

where $K_\theta$ and $K_{\theta p}$ are assumed to be negative.

There is a compromise between the cart 62 position trajectory and the kinematic links 34 oscillations cancellation. In regards to the equations, this is due to the transfer function zeros.

Pole placement is used using the characteristic equation:

$$(s+p_1)^2(s^2+2\zeta_1\omega_{n1}+\omega_{n1}^2)$$

Equaling the previous equations for the system poles and pole placement provides:

$$2\zeta_1\omega_{n1} + 2p_1 = K_v + \frac{K_{\theta p}}{L}$$

$$\omega_{n1}^2 + 4\zeta_1\omega_{n1}p_1 + p_1^2 = \frac{K_\theta}{L} + K_x + \frac{g}{L}$$

$$2\omega_{n1}^2 p_1 + 2\zeta_1\omega_{n1}p_1^2 = \frac{K_v g}{L}$$

$$\omega_{n1}p_1^2 = \frac{K_x g}{L}$$

and then the following are used:

$$K_x = \frac{\omega_{n1}^2 p_1^2 L}{g}$$

$$K_v = \frac{2\omega_{n1}p_1 L(\omega_{n1} + \zeta_1 p_1)}{g}$$

$$K_\theta = \left(\omega_{n1}^2 + 4\zeta\omega_{n1}p_1 + 2p_1 - K_x - \frac{g}{L}\right)L$$

$$K_{\theta p} = (2\zeta_1\omega_{n1} + 2p_1 - K_v)L$$

where $$\omega_{n1} \geq \sqrt{\frac{g}{L}}$$

and $\zeta$ are design parameters and $p_1$ is heuristically chosen to be equal to $\omega_{n1}$ as to lie on the same circle as the other poles. It is a design choice to use two complex poles and two equal real poles as other choices are possible. The state space controller 63 gains to adapt are thus obtained. The transfer function zero influence the response but without practical effect since it is relatively high. $\omega_{n1}$ is chosen very close to $$\sqrt{\frac{g}{L}},$$

but not too close to avoid numerical problems.

One should note that the operator 28 can still push the payload 12 in autonomous mode. The cart 62 position will move in the direction desired by the operator 28, while being attracted to its reference position and cancelling oscillations of the movement device 22. Depending on the control gains, it will be more or less easy to move the cart 62 away from its reference position. Referring to FIG. 6, the control block 86 will then be used with these gains to manage autonomous and cooperation with the operator 28, while stabilizing the movement device 22.

Neglected terms from the complete model as $\dot{L}$, $\dot{\beta}$, $\dot{\theta}^2$ and viscous friction can be compensated for, for example, with gains $K_\theta$ and $K_{\theta p}$ by considering the terms constant over a time step, similarly as with the lengths L of the kinematic links 34.

Control gains can also be heuristically modified from the computed gains. Additionally, control gains on $\theta_{p0}$ and $\theta_{p2}$ and their derivatives can be different from one another.

When switching between the modes, i.e., cooperation mode, autonomous mode, stopping, and the like, rude acceleration and jerk profile may be required. The most frequent abrupt profile happens when switching modes when the angles $\theta_1$ and $\theta_2$ of the kinematic links 34 are non-zero. "Bumpless" transfer or smooth transfer between modes may be achieved. In one embodiment, the last control input is memorized or observed. In another embodiment, the measured velocity is memorized when the mode switch happens. In the cooperation mode, the output bumpless velocity is as follows:

$$v_{DesBumpl}=a_{bt}v_{mem}+(1-a_{bt})v_{des}$$

The variable $a_{bt}$ is reinitialized at 1 when a mode switch happens and is then multiplied by $b_{bt}$ at each time step. At first $v_{DesBumpl}$ is then equal to the measured velocity ($v_{mem}$) and after some time, depending on parameter $b_{bt}$, $a_{bt}$ goes to 0 and $v_{DesBumpl}$ to $v_{des}$. $b_{bt}$ should be defined as a parameter to be chosen by the designer. The goal is to go from the present velocity as the mode switch moment ($v_{mem}$) to the desired velocity ($v_{des}$) in a smooth filtered way. For the autonomous mode, the desired position is first reset to the measured position and the desired bumpless velocity is integrated to obtain a new desired position respecting this velocity. Further smoothing may also be possible by considering the acceleration in the mode switch.

It should also be appreciated that the movement device 22 may be configured such that the payload 12 may include an end effector which is slidable, relative to the four-bar mechanisms 24*a*, 24*b* and which also allows the payload to be rotated, as indicated at 94 in FIG. 1. Movement in a vertical direction may be accomplished between the movement device 22 and the trolley 20 or between the movement device 22 and the end effector. More specifically, the end effector may include a slidable and rotatable mechanism such that the payload 12 could be translated on the four-bar mechanisms 24*a*, 24*b* or rotated about 94.

While the best modes for carrying out the disclosure have been described in detail, those familiar with the art to which this disclosure relates will recognize various alternative designs and embodiments for practicing the disclosure within the scope of the appended claims.

The invention claimed is:

1. A movement system configured for moving a payload, the movement system comprising:

a bridge crane configured for movement along an X axis;

a trolley movably attached to the bridge crane and configured for movement along a Y axis, in perpendicular relationship to the X axis;

a movement device depending from the trolley along a Z axis, wherein the movement device includes:

a first four-bar mechanism and a second four-bar mechanism which is operatively connected to and is suspended from the first four-bar mechanism;

wherein each of the first and second four-bar mechanisms has a pair of kinematic links and a pair of base links;

wherein the pair of kinematic links extend in spaced and parallel relationship to one another;

wherein the pair of base links extend in spaced and parallel relationship to one another and are pivotally and directly connected to ends of the pair of kinematic links to form a plurality of joints therebetween, wherein the plurality of joints includes only a first, second, third, and fourth joint therebetween;

wherein the pair of kinematic links and the corresponding pair of base links form a parallelogram;

wherein the first joint of the first four-bar mechanism and the third joint of the second four-bar mechanism each define a respective first axis;

wherein the second joint of the first four-bar mechanism and the fourth joint of the second four-bar mechanism each define a respective second axis;

wherein the third joint of the first four-bar mechanism and the first joint of the second four-bar mechanism each define a respective third axis;

wherein the fourth joint of the first four-bar mechanism and the second joint of the second four-bar mechanism each define a respective fourth axis;

wherein the first, second, third, and fourth axis of the first four-bar mechanism extend in parallel relationship to one another and the first, second, third, and fourth axes of the second four-bar mechanism extend in parallel relationship to one another;

wherein the kinematic links are rotatable about the respective first, second, third, and fourth axis, while the kinematic links remain in spaced and parallel relationship to one another, such that the pair of kinematic links and the corresponding pair of base links continuously form the shape of a parallelogram;

wherein each of the first, second, third, and fourth axes of the first four-bar mechanism is disposed in perpendicular relationship to each of the first, second, third, and fourth axes of the second four-bar mechanism;

a sensor operatively attached to one of the joints of one of the first and second four-bar mechanisms;

wherein the sensor is configured to measure an angle of rotation of the respective kinematic link about the respective axis.

2. A movement system, as set forth in claim 1, wherein the movement device further includes a cart operatively connected to the trolley and the bridge crane;

wherein the cart is configured to move at least one of the trolley and the bridge crane along the corresponding X axis and Y axis, as a function of the measured angle of rotation of the respective kinematic link about the respective axis.

3. A movement system, as set forth in claim 2, further comprising a controller operatively connected between the sensor and the cart;

wherein the controller is configured to receive a signal from the sensor indicating the measured angle of rotation of the respective link and, in turn, send a signal to the cart to move the cart along the corresponding X axis and the Y axis.

4. A movement system, as set forth in claim 3, wherein the sensor includes:

a pair of encoders operatively connected to one of the joints of each of the first and second four-bar mechanisms; and a pair of sensors operatively connected to one of the joints of each of the first and second four-bar mechanisms;

wherein the sensor and the encoder corresponding to the respective first and second four-bar mechanisms are configured to provide a signal to the controller corresponding to the angle of rotation of the respective kinematic links.

5. A movement system, as set forth in claim 4, wherein the sensors are Hall effect sensors.

6. A movement system, as set forth in claim 1, wherein the movement device further includes a pair of tubes extending from the second four-bar mechanism, along the Y axis;

wherein the pair of tubes are configured for supporting a payload, offset from the Z axis.

7. A movement system, as set forth in claim 6, wherein the movement device further includes:

an articulated joint extending from at least one of the pair of tubes such that the articulated joint is offset from the Z axis; and an attachment point extending from the articulated joint such that the attachment point is configured for supporting the payload.

8. A movement device depending from a trolley along a Z axis and configured for moving along at least one of an X axis and a Y axis, wherein the movement device includes:

a first four-bar mechanism and a second four-bar mechanism which is operatively connected to and is suspended from the first four-bar mechanism;

wherein each of the first and second four-bar mechanisms has a pair of kinematic links and a pair of base links;

wherein the pair of kinematic links extend in spaced and parallel relationship to one another;

wherein the pair of base links extend in spaced and parallel relationship to one another and are pivotally and directly connected to ends of the pair of kinematic links to form a plurality of joints therebetween, wherein the plurality of joints includes only a first, second, third, and fourth joint therebetween;

wherein the pair of kinematic links and the corresponding pair of base links form a parallelogram;

wherein the first joint of the first four-bar mechanism and the third joint of the second four-bar mechanism each define a first axis;

wherein the second joint of the first four-bar mechanism and the fourth joint of the second four-bar mechanism each define a second axis;

wherein the third joint of the first four-bar mechanism and the first joint of the second four-bar mechanism each define a third axis;

wherein the fourth joint of the first four-bar mechanism and the second joint of the second four-bar mechanism each define a fourth axis;

wherein the first, second, third, and fourth axes of the first four-bar mechanism extend in parallel relationship to one another and the first, second, third, and fourth axes of the second four-bar mechanism extend in parallel relationship to one another;

wherein the kinematic links are rotatable about the respective first, second, third, and fourth axes, while the kinematic links remain in spaced and parallel relationship to one another, such that the pair of kinematic links and the corresponding pair of base links continuously form the shape of a parallelogram;

wherein each of the first, second, third, and fourth axes of the first four-bar mechanism is disposed in perpendicular relationship to each of the first, second, third, and fourth axes of the second four-bar mechanism;

a sensor operatively attached to one of the joints of one of the first and second four-bar mechanisms;

wherein the sensor is configured to measure an angle of rotation of the respective kinematic link about the respective axis.

9. A movement system, as set forth in claim 8, wherein the movement device further includes a cart configured to be connected to the trolley;

wherein the cart is configured to move at least one of the trolley and a bridge crane along the corresponding X axis and Y axis, as a function of the measured angle of rotation of the respective kinematic link about the respective axis.

10. A movement system, as set forth in claim 9, wherein the sensor includes:

a pair of encoders operatively connected to one of the joints of each of the first and second four-bar mechanisms; and a pair of sensors operatively connected to one of the joints of each of the first and second four-bar mechanisms;

wherein the sensor and the encoder corresponding to the respective first and second four-bar mechanisms are configured to provide a signal to the controller corresponding to the angle of rotation of the respective kinematic links.

11. A movement system, as set forth in claim 10, wherein the sensors are Hall effect sensors.

12. A movement system, as set forth in claim 8, wherein the movement device further includes a pair of tubes extending from the second four-bar mechanism, along the Y axis;

wherein the pair of tubes are configured for supporting a payload, offset from the Z axis.

13. A movement system, as set forth in claim 12, wherein the movement device further includes:

an articulated joint extending from at least one of the pair of tubes such that the articulated joint is offset from the Z axis; and an attachment point extending from the articulated joint such that the attachment point is configured for supporting the payload.

* * * * *